United States Patent [19]

Galassi

[11] 4,090,499

[45] May 23, 1978

[54] AIR VENTILATING AND CONDITIONING APPARATUS

[75] Inventor: Abramo Galassi, Perugia, Italy

[73] Assignee: FLAMINIA S.p.A. - Apparecchiature per Ricambio e Depurazione Aria, Perugia, Italy

[21] Appl. No.: 736,320

[22] Filed: Oct. 28, 1976

[30] Foreign Application Priority Data

Oct. 28, 1975 Italy ..... 629 A/75

[51] Int. Cl.[2] ..... F24C 15/08; F23J 11/00

[52] U.S. Cl. ..... 126/299 D; 55/DIG. 36; 62/238

[58] Field of Search ..... 126/299 D; 55/DIG. 36; 62/238

[56] References Cited

U.S. PATENT DOCUMENTS

| | | | |
|---|---|---|---|
| 2,886,124 | 5/1959 | Scharmer | 126/299 D |
| 3,233,606 | 2/1966 | Turner et al. | 126/299 D |
| 3,719,137 | 3/1973 | Gould | 126/299 D |

*Primary Examiner*—Ronald C. Capossela
*Attorney, Agent, or Firm*—Harold L. Stowell

[57] ABSTRACT

The apparatus is capable of depurating the air of small-sized ambients or rooms, such as kitchens, rooms situated on board of vehicles, etc. and it comprises a housing A for a ventilator or fan 10–12 having a vertical axis and which shows two distributing chambers 16–28. The said chambers are in communication with the room and with the atmosphere and, through commutatable intercepting members 22–38, with the delivery and the intake of the ventilator, while part of the openings of the above mentioned distributing chambers are provided with heat sources 20–46, either to heat or to cool the air which is insufflared into the ambient or room concerned.

3 Claims, 3 Drawing Figures

AIR VENTILATING AND CONDITIONING APPARATUS

The present invention concerns an air depurating and exchanging apparatus, designed for installation in ambients with limited dimensions, in particular in kitchens, as well as in cabins of vehicles, such as caravans, motorboats and the like.

The scope of the present invention is to realize an apparatus of limited dimensions which is easy to instal in the desired position, for taking-in and expelling the gas and the vitiated air from ambients with a limited capacity, such as domestic kitchens, the available space whereof is, in general, substantially limited.

In particular, the apparatus object of the present invention is designed for installation above the cooking unit, to take-in and to expel the unpleasant smells and the vapours which develop in a kitchen. Another purpose of the present invention is the ventilation, as well as the removal of the air contained in the ambients concerned, as well as to heat and, if desired, to cool the ambient.

The apparatus object of the present invention is characterized in that it comprises at least one ventilator or fan installed in a housing having two chambers provided with openings, said openings being connected with the ambient and with the atmosphere respectively and provided with commutatable intercepting members, to realize the desired circuit between the ambient, the atmosphere and the fan or ventilator respectively, whilst at least part of the said openings are provided with heat sources, in order to heat and/or cool the air which is blown into the room concerned.

According to an advantageous embodiment of the present invention, the air suction duct of the ventilator or fan is connected to the room concerned through an opening in the housing of the apparatus, such opening being checked by one of the commutatable intercepting members, while the other of the said intercepting members is checked by the delivery of the of the fan or ventilator.

The present invention will be now explained in the following description, wherein reference is made to the annexed drawing showing, by way of example, an advantageous form of embodiment of the apparatus, provided with two heat source units, to heat and/or to cool the air which is introduced into the ambient in question.

Figure 1:
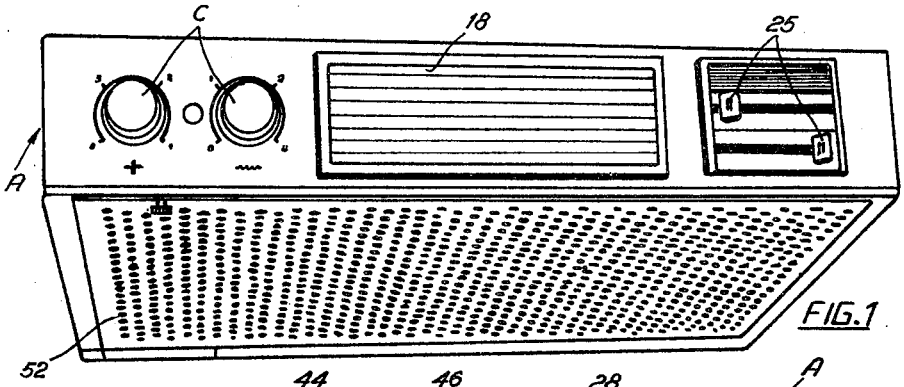
FIG. 1 is a perspective view of the apparatus for installation on the ceiling of a kitchen.

The illustrated apparatus comprises a substantially parallelepipedically shaped, flattened housing A, which extends in a horizontal direction, to allow for the installation of the apparatus within a limited space. For example, it is possible to instal the apparatus above a hot cooking plate, thus providing a hood for said plate. The apparatus can be installed advantageously, according to the shape of housing A, below a pensile piece of kitchen furniture, to rationally complete the equipment of the said kitchen.

The central part of housing A includes the volute or scroll 10 for a matching fan wheel 12 for a ventilator actuated by a motor. The final length 14 of volute 10 provides the delivery duct of the ventilator, said duct delivering into a distributing chamber 16 that extands substantially all along the width of housing A and shows an opening 18 which opens into the ambient concerned. Opening 18 is provided with a grid to screen heat source 20 which consists advantageously of thermoelectric resistances.

The delivery opening 14 of the ventilator or fan 10–12 comprises a lock-grid 22, the shaft 24 whereof projects into housing A and is provided with a manoevering member 24' by means of which the above mentioned lock-grid is displaced either to the one or to the other of the two positions 22 and 22', shown in FIG. 1 with continuous and with dotted lines respectively. When lock-grid 22 is in position 22' it closes the communication between delivery 14 of ventilator 10–12 and the distribution chamber 16, thus establishing a communication between the said delivery and a second chamber of distribution, as it will be explained in the following. When lock-grid 22 is in the position shown with a continuous line (FIG. 2), it provides for the establishment of a communication between delivery 14 of the ventilator and chamber 16, as well as for the interception of the communication between said delivery 14 and duct 26 which delivers into a second chamber of distribution 28 opposed to chamber 16. Volute 12 of ventilator 10–12 shows, at its central part, an axial opening 30, which forms the intake duct, said duct being connected to a duct 32 (FIG. 2) extending all along the outer lower wall 34 of housing A. Duct 32 ends with an opening 36 in communication with the distributing chamber 28, while the said opening can be closed by means of a lock-grid 38, the shaft 40 whereof is joined by means of appropriate kinematic connections 41, to shaft 24 of lock-grid 22, in order to realize the simultaneous control of the two lock-grids 22 and 38. The kinematic connections 41 between shafts 24' and 40 are provided also with a clutch member, that consents to establish the most favourable conditions for realizing the single control or the simultaneous control of lock-grids 22 and 38, as will be explained in the following. Lock-grid 38 can take two positions 38 and 38', as shown in FIG. 3, with a continuous line and with a dotted line respectively. In the first mentioned position, lock-grid 38 closes an opening 42 provided in wall 34 of housing A, so as to connect take-in duct 30 of the ventilator or fan 10–12 with the distributing chamber 38 and thereafter, with the atmosphere. On the other hand, when lock-grid 38 is in position 38', intake-duct 30 is connected with the room to be ventilated, whilst the delivery 14 of the ventilator is connected with the abovementioned distributing chamber 28, inasmuch as lock-grid 22 is shifted over to position 22 shown in FIG. 2. At the other end of housing A, distributing chamber 28 shows a large opening 44, advantageously connected with the atmosphere and closed by grid 36. In the illustrated case, the apparatus comprises a second heat source 46, to cool the air which is introduced into the ambient; therefore, grid 46 consists of a winged coil which forms part of the evaporator of refrigerating unit B, housed in a compartment 48 obtained in the structure of housing A and connected with the surrounding by means of ventilating duct 50. With reference to the location and the installation of the apparatus claimed with the present application it should be noted that housing A of said apparatus has, at the lower part thereof and near wall 34, a screen provided with a grid 52 to diffuse and to distribute the air delivered through opening 42 and which flows into the ambient.

The above described apparatus is provided with adjustable members C, to check the temperature of the air contained in distributing chambers 16 and 28 at regular intervals, in order to connect or disconnect heat sources 20 and 46 as well as to check the actuation of either the one or the other of said heat sources, in such a way that, when one of said sources is being fed, the other is closed and vice versa. It is possible to connect the said members in turn operatively with the drives for lock-grids 22 and 38, according to the ventilating circuit which is established each time.

Figure 2:
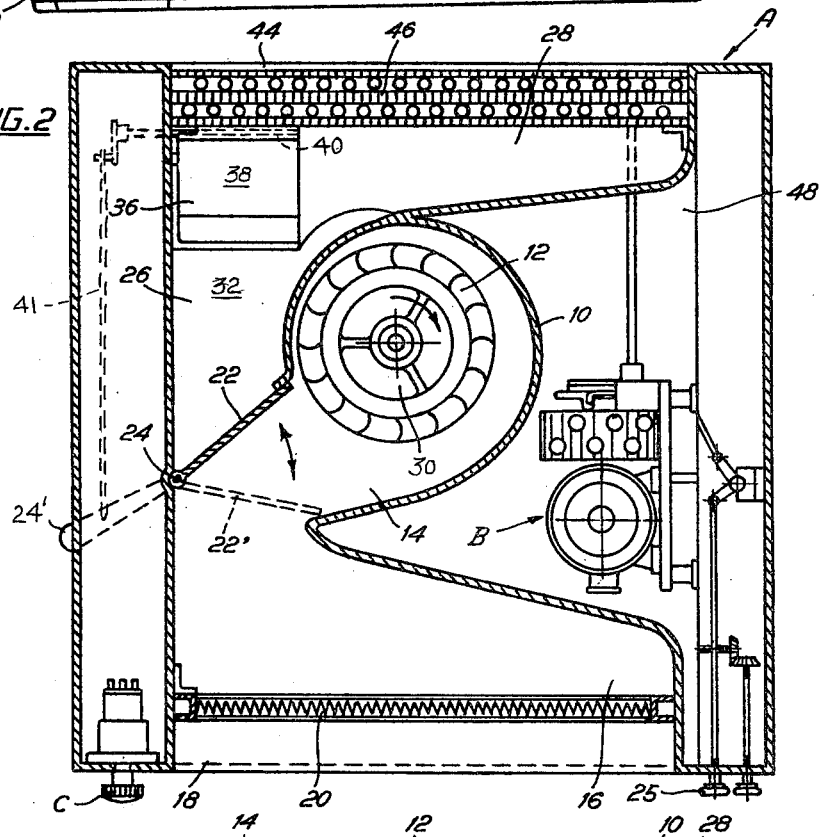
FIG. 2 is a horizontal section through the longitudinal level of the apparatus.
Figure 3:
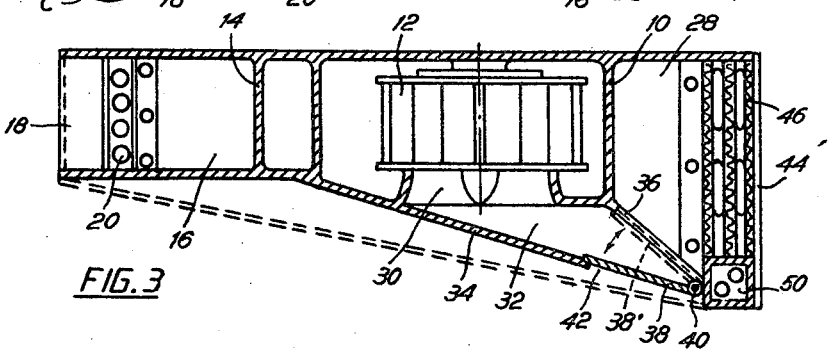
FIG. 3 is the transversal or cross-section.

When the apparatus as above described operates and, during its different performances, ventilating unit 10–12 is always operating. The performances which can be realized by means of the apparatus object of the present invention, are the following:

(I) To remove and to renew the vitiated air of the ambient, lock-grid 22 is moved into position 22' shown with dotted lines in FIG. 2 and lock-grid 38 to position 38' as shown in FIG. 3. As a consequence, suck-in duct 30 of the ventilator 10–12 is connected, through duct 32 and opening 42, with the ambient concerned, whilst the delivery of said ventilator is connected with chamber 28 and hence with the atmosphere.

(II) To ventilate and to renew the air of the ambient, lock-grid 22 is moved to position 33 shown in FIG. 2, whilst lock-grid 38 is arranged in position 38, shown in FIG. 3, to close opening 42 and to open opening 36. In this case, suck-in opening 30 is connected with the atmosphere, whilst delivery 14 is connected with the ambient through chamber 16; in this case the ambient is being ventilated and the air renewed. It is understood that it is possible to heat the ambient by activating the thermoelectric resistance 20; or otherwise it is possible to condition said ambient, by actuating unit B to cool the air which is insufflated into the said ambient or room.

III. To heat or to cool the ambient in closed circuit, lock-grid 22 is maintained in position 22, of FIG. 2; whilst lock-grid 38 is moved into position 38' of FIG. 3; in this case the air contained in the ambient is being sucked-in through opening 42 and conveied into chamber 16, to be heated by means of heat source 20 and thereafter insufflated into the ambient.

Modifications and variations can be brought to the apparatus claimed with the present application, according to the requirements of the single end-users thereof. For example, the apparatus can be furnished without refrigerator unit B or otherwise, if desired, without heat source 46 and fed, instead with unit B, by means of any other heat generator at low temperatures, mounted in the ambient in consideration. On request of the end-user, the side walls of housing A can be equipped with downwardely looking screens, in order to form a hood proper for the aspiration of the vapours produced by the food cooking procedure.

In the practice, the details of the embodiment and the end uses thereof can be varied, without depassing the limits of the present invention nor of the above described patent of invention.

I claim:

1. Air ventilating and conditioning apparatus for a room comprising a housing, a motor driven fan in said housing, first and second air distributing chambers in said housing, said first chamber communicating with the fan and the room, said second chamber communicating with the fan, the room and the ambient atmospher, first damper means mounted in said housing and movable from a first position blocking communication between the fan and the second chamber to a second position blocking communication between the fan and the first chamber, a second damper means mounted in said housing and movable to open and close communication between the second chamber and the room, control means connecting the first and second dampers so that when the first damper blocks communication between the fan and the second chamber the second damper is closed and when the first damper blocks communication between the fan and the first chamber the second damper is open, air heater means in said first chamber and air cooling means in said second chamber.

2. The invention defined in claim 1 wherein the opening to the atmosphere from the second chamber and the opening to the room from the first chamber are on opposite sides of the housing.

3. The invention defined in claim 2 wherein the fan is positioned between said two openings.

* * * * *